United States Patent [19]

Hallen

[11] Patent Number: 4,902,304

[45] Date of Patent: Feb. 20, 1990

[54] SEPARATE LOW PRESSURE GAS STORAGE SYSTEM

[75] Inventor: Walter R. Hallen, Oconomowoc, Wis.

[73] Assignee: Envirex Inc., Waukesha, Wis.

[21] Appl. No.: 147,585

[22] Filed: Jan. 21, 1988

Related U.S. Application Data

[63] Continuation of Ser. No. 860,613, May 7, 1986, abandoned.

[51] Int. Cl.[4] ..... F17B 1/14; F17B 1/26

[52] U.S. Cl. ..... 48/174; 48/178; 220/85 B; 220/426

[58] Field of Search ..... 48/111, 174, 178; 210/218, 603, 612; 220/85 A, 85 B, 421, 426

[56] References Cited

U.S. PATENT DOCUMENTS

| | | | |
|---|---|---|---|
| 3,028,040 | 5/1961 | Woodard et al. | 220/85 |
| 3,049,070 | 8/1982 | Hawk . | |
| 3,122,985 | 3/1964 | Osborne . | |
| 4,060,175 | 11/1977 | Rysgaard | 220/85 |
| 4,323,367 | 4/1982 | Ghosh | 48/197 A |
| 4,396,402 | 8/1983 | Ghosh | 48/197 A |
| 4,401,441 | 8/1983 | Chase | 48/111 |
| 4,437,987 | 3/1984 | Thornton | 210/137 |
| 4,579,654 | 4/1986 | Bremmer | 48/111 |

*Primary Examiner*—Peter Kratz

*Attorney, Agent, or Firm*—Michael, Best & Friedrich

[57] ABSTRACT

A low pressure gas storage system comprising an annular anchor ring, a granular bed within the ring, a flexible membrane of gas storage chamber positioned above the bed, and a flexible membrane of air chamber encompassing the gas storage chamber and exerting pressure thereon; and a plurality of flexible, radially-extending restraining means positioned against and over the air chamber to exert a predetermined pressure thereon.

10 Claims, 2 Drawing Sheets

SEPARATE LOW PRESSURE GAS STORAGE SYSTEM

This is a continuation of application Ser. No. 860,613, filed May 7, 1986 and now abandoned.

BACKGROUND OF THE INVENTION

The present invention relates to gas storage devices, and more specifically, to low pressure gas storage devices used in conjunction with gas produced by wastewater treatment plants.

The most familiar form of separate gas storage consists of fixed-volume, high pressure steel gas spheres. Storage is achieved by compressing the gas from 6–8 inches of water column, to 50–100 psig. The gas is then regulated back to 6–8 inches of water column, for use. These high pressure storage spheres and associated compressors are very expensive and require considerable operational and maintenance expenditures.

The use of digester tanks utilizing anaerobic processes to treat wastewater sludge is well known and practiced in the art. During the anaerobic process, gases, typically methane and carbon dioxide, are given off and collected to be used either as fuel for heating the sludge mixture, or for commercial use by utilities.

Typical anaerobic digester tanks have a capacity for the storage of evolved gasses which is limited by the size of the tank and the construction of the tank cover. Many of the systems employ a floating gas holder positioned above the sludge which collects the gas and exerts a controlled downward pressurizing force on it. Floating gas holders have proved to be less than satisfactory due to their inherent problems of corrosion, freezing, tipping and leaking.

Attempts to replace floating gas holders have typically involved the construction of a rigid dome over the digester tank, and at least one membrane located beneath the dome for collecting and pressurizing the gas, as well as a center stack or gas well to provide an attachment point for the membrane and access to the interior of the tank for periodic maintenance. Digester covers of this type are expensive to produce, and often provide limited gas storage capacity. In addition, many plant operators find that the technical and economic factors associated with converting conventional digester covers to fixed cover-membrane type apparatus make such conversions impractical.

Thus, there is a need for a relatively low cost, low maintenance gas storage system which can be located practically anywhere gas needs to be stored and, especially, separately from a gas-generating operation, such as an anaerobic wastewater treatment tank. It is the object of the present invention to provide a separate gas storage system which satisfies the above-identified design objectives.

SUMMARY OF THE INVENTION

The present invention provides a low-cost, simple, low-pressure gas storage system for use in conjunction with the distribution of natural gas or the gas-producing aspects of wastewater treatment facilities, landfills or refuse disposal sites.

More specifically, a gas storage system is provided wherein the use of extensive rigid support walls and covers is eliminated. Instead, a dual-bladder type flexible membrane assembly is enclosed only by an anchor ring and a plurality of tensioned restraining cables. The dual-bladder system comprises an inner gas-filled chamber connected to a source of gas. A specified level of pressure is maintained upon the gas storage chamber by an outer flexible membrane which creates an air-filled chamber. The volume of air within the outer chamber compensates for changes in the volume of gas in the inner chamber to maintain a constant pressure thereon.

The outer air membrane is secured by a plurality of restraining cables. These cables define the curvature of the outer membrane to relieve stress on the flexible membrane material.

BRIEF DESCRIPTION OF THE DRAWINGS

The many attributes and advantages of the present invention will become more apparent upon a review of the drawings, in which.

DESCRIPTION OF THE PREFERRED EMBODIMENT

Figure 1:
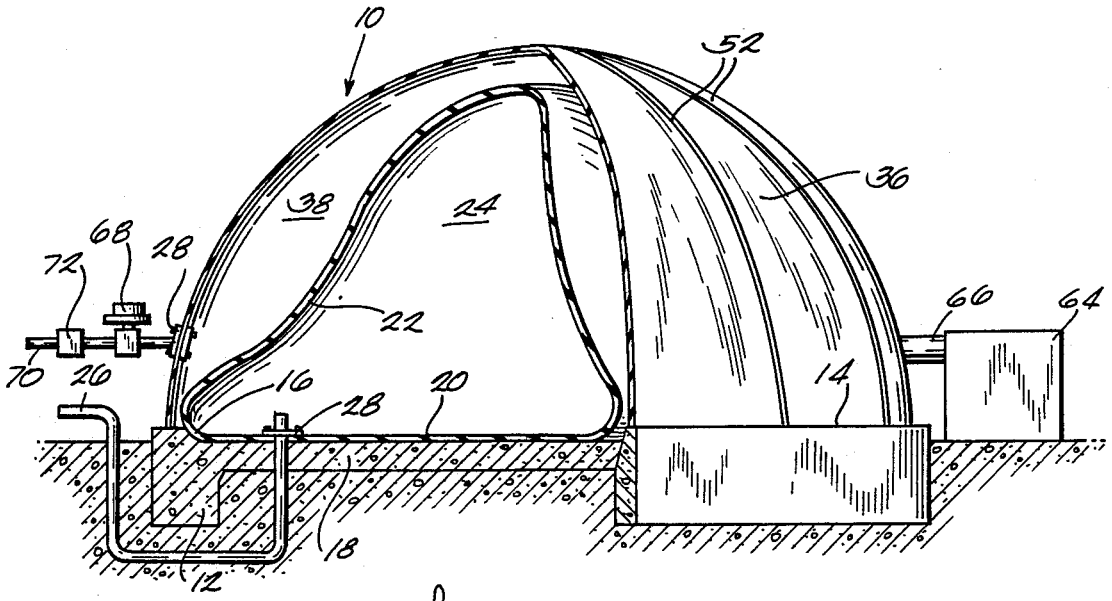
FIG. 1 depicts an elevational view in partial section of the gas storage system of the present invention.

Referring now to the drawings, wherein like reference characters designate like elements, a low pressure separate gas storage unit 10 is pictured. Storage unit 10 is comprised of an annular or peripheral anchor ring 12 partially set into the substrate. Anchor ring 12 is preferably fabricated of a flow and set material such as concrete. Anchor ring 12 is further comprised of an outer shoulder 14 and a downwardly sloping interface 16. Interface 16 supports gas membrane 22 described below.

A floor 18, comprising a bed of particulate material such as sand, pea gravel or poured concrete is located within the area enclosed by anchor ring 12. Floor 18 is prepared to have a substantially level surface upon which floor membrane 20 may be laid. Floor membrane 20 is positioned upon floor 18, is substantially co-extensive with the confines of anchor ring 12, and is fabricated of a polymeric material which is gas impervious and abrasion resistant. Preferred floor membrane materials are polyvinyl chloride or vinyl coated polyester fabric having nonmigrating plasticizers.

A gas membrane 22, fabricated of material having properties similar to the floor membrane 20, is positioned above the floor membrane to create gas storage chamber 24. Gas membrane 22 and floor membrane 20 are sealingly secured to each other along their respective outer peripheries by heat welding or adhesives, or by the annular anchor plate 40 described below.

Gas is fed into chamber 24 via gas connection 26 which passes under anchor ring 12, through floor 18, and is sealingly secured to gas membrane 22 by a conventional flange plate 28 and backing plate 30 held in place by bolts 32. Connection 26 may convey gas from a transmission pipeline or another source of gas.

A second membrane 36 is positioned to encompass the gas membrane 22 and to create an air chamber 38 above gas membrane 22. Air membrane 36 is fabricated of a gas-impervious, durable yet flexible material such as vinyl coated polyester. Air membrane 36 is sealingly secured to the shoulder 14 of anchor ring 12 by anchor plate 40 and anchor bolts 42 embedded in anchor ring 12. The sealing qualities of this arrangement are enhanced by gaskets 44 and 46. The outer margin of membrane 36 is provided with annular bead 43 of rope-like material.

Anchor ring 12 is also provided with a plurality of cable anchors 48 fixed thereto in spaced relationship, each of which is provided with a mounting eyelet 50. A plurality of flexible restraining members 52 are arranged to define the curvature of air membrane 36 once it is inflated. The restraining members may be lengths of rope, sheathed chain, tie bars or wire cable. Each member 52 has two ends, each of which is provided with an eyelet 54. One end of the member is secured to cable anchor 48 via bolt 56 passing through eyelet 50. The restraining members 52 are preferably of a length such that each member may circumscribe air membrane 36. In that case both ends of the members 52 are secured to the anchor ring 12 in approximately diametrically opposed positions. When necessary, the members 52 may be maintained in proper orientation at the apex of membrane 36 by a positioning ring (not shown).

Alternatively, the cables may extend only to the apex of the outer membrane. A positioning ring 58 is located at the top of membrane 36 to maintain the members 52 in proper position. Ring 58 is comprised of circular base 60 and a plurality of brackets 62 positioned to hold each restraining member 52 in proper position. The restraining members 52 are pivotally secured to brackets 60 by fasteners 61, which may be pins or bolts.

Figure 2:
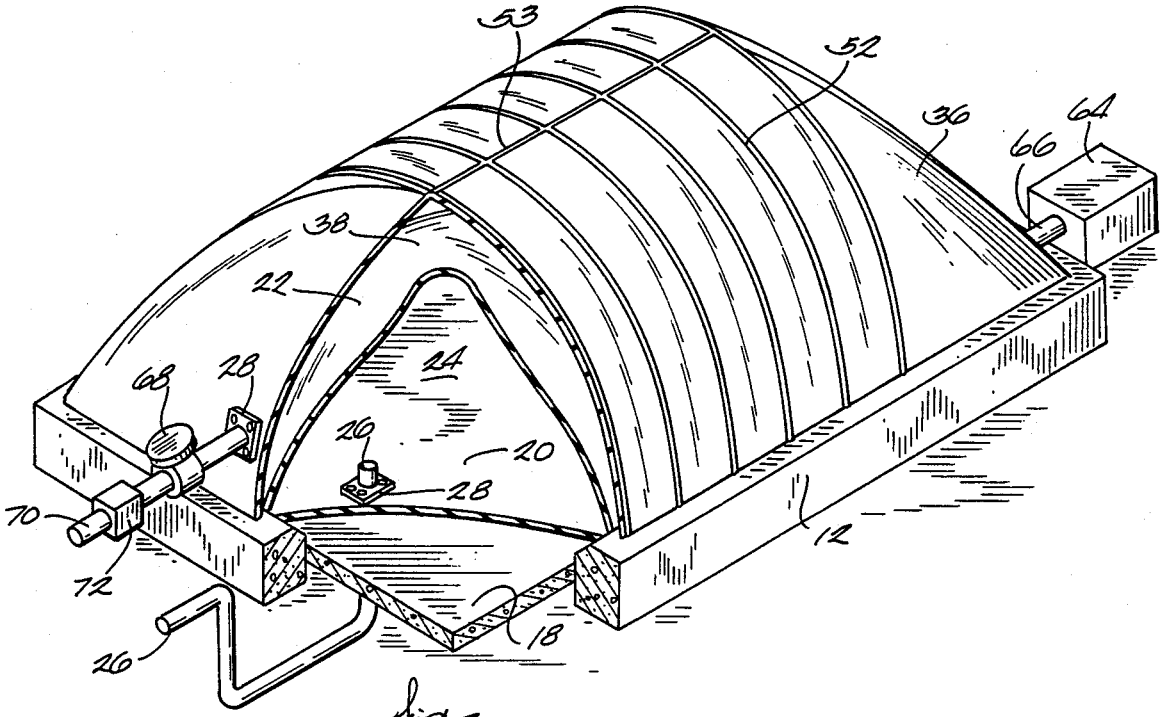
FIG. 2 depicts a perspective elevation in partial section of an alternate embodiment of the present invention.
Figure 3:
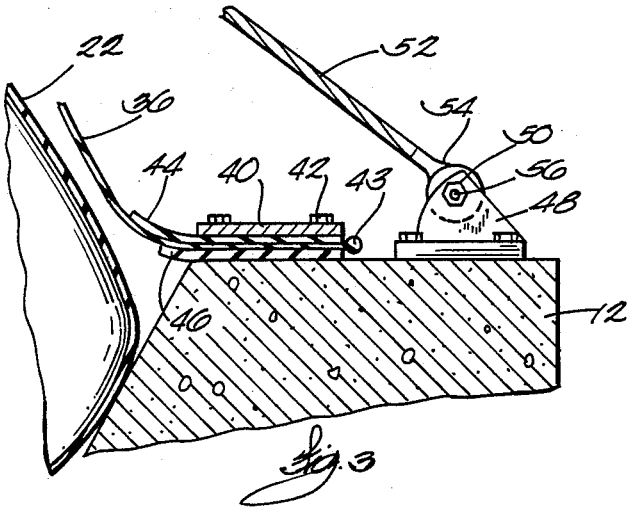
FIG. 3 depicts an enlarged elevational view in partial section of the means of attaching the membranes and cables to the anchor ring.
Figure 5:
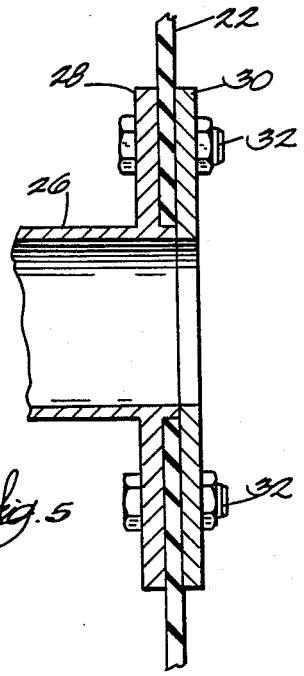
FIG. 5 depicts an enlarged elevation in partial section of the gas/air outlet membrane seal.
Figure 4:
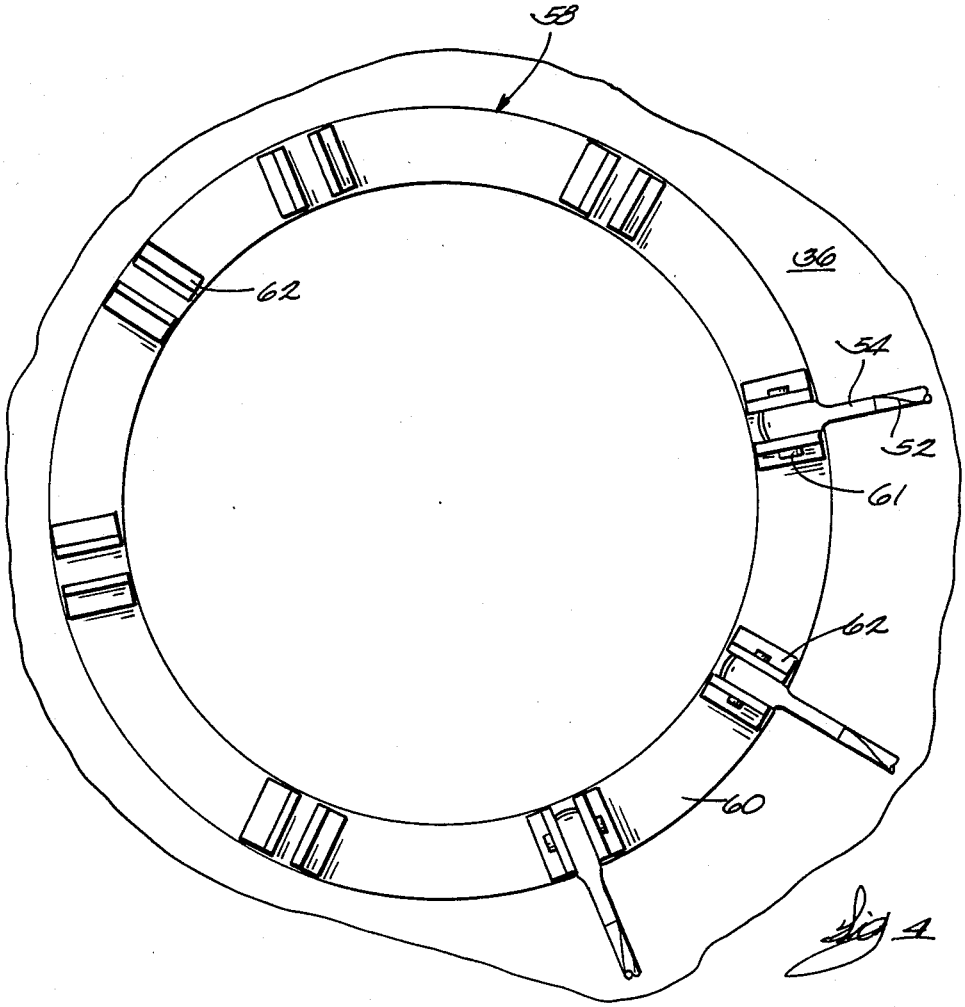
FIG. 4 depicts an enlarged plan view of the cable positioning device.

FIG. 2 depicts an alternate embodiment of the present gas storage apparatus. Instead of the preferred spherical shape, an elongate configuration is provided, which differs from the preferred version principally in the arrangement of the restraining members 52. A centrally-positioned member 53 runs along the length of outer membrane 38. The remainder of restraining members 52 straddle membrane 38 and intersect member 53 at an approximate 90° angle. When necessary, the cables 52 and 53 may be secured at their intersection by tie-down means (not shown).

Air membrane 36 is inflated by means of an air blower 64 and air conduit 66, which create pressure on gas membrane 22. The pressure exerted by air chamber 38 on gas membrane 22 is regulated by pressure relief valve 68. Air outlet 70 is sealingly secured to air membrane 36 and is designed to permit a continual flow of air from chamber 38.

The normal tendency of gas membrane 22 to leak small quantities of gas into air chamber 36 creates a potentially explosive condition and must be alleviated. To this end, blower 64 and air outlet 70 are positioned around storage unit 10 to create a flow of air across gas membrane 22 which dilutes and dissipates any escaping gas. As a safety measure, gas detection device 72 may be mounted on air outlet 70 to monitor the presence of gas in the air flowing therethrough. Best results have been achieved by placing blower 64 approximately 180° away from air outlet 70.

In operation, the present invention is similar to commonly-assigned U.S. Pat. No. 4,437,987 to Thornton, et al. Evolved gas is fed through connection 26 into gas storage chamber 24. In order to maintain a pre-set pressure on chamber 24, air is blown into air chamber 38 by blower 64. The pressure release valve 68 is calibrated so that the amount of air maintained in chamber 38 is sufficient to exert a preset pressure on the gas in storage chamber 24, regardless of the volume of that gas.

Restraining members 52 are designed to define the curvature of air membrane 36 so that the membrane fabric is not subjected to undue stress loading. The membrane fabric tends to bulge outwardly between respective restraining members, and the curvature of that bulge is designed to lower the stress on the membrane fabric.

Thus, the present invention discloses a separate low pressure gas storage system comprised of a flexible gas storage chamber and an inflated, pressurizing air chamber, those chambers being restrained only by an annular anchor ring and a plurality of flexible restraining members respectively.

Although a particular embodiment of this process has been described, it will be obvious to persons skilled in the art that changes and modifications might be made without departing from the invention in its broader aspects.

What is claimed is:

1. A gas storage system comprising:

a floor;

anchor means surrounding the floor;

a flexible floor membrane positioned upon said floor and having a periphery being substantially coextensive with said anchor means;

a flexible gas storage membrane overlying said flexible floor membrane and having a periphery sealingly secured to the periphery of said flexible floor membrane, said flexible gas storage membrane and said floor membrane forming a flexible gas storage chamber therebetween;

gas inlet and outlet means connecting said gas storage chamber to a supply of gas;

a flexible air membrane having an exterior and encompassing said gas storage membrane and having a periphery sealingly secured to said periphery of said flexible gas storage membrane, said flexible air membrane overlying said flexible gas storage membrane to form a flexible cover over said flexible gas storage membrane and to form an air chamber over said gas storage chamber;

air supply means;

air inlet means connecting said air chamber with said air supply means;

air outlet means for venting air from said air chamber; and a plurality of flexible restraining members extending over the flexible air membrane for restraining the inflated flexible air membrane, said flexible restraining members each having two ends and positioned against the exterior of said flexible air membrane so that at least one of said ends is secured to said anchor means.

2. The apparatus defined in claim 1 wherein said restraining members are secured at both ends to said anchor means.

3. The apparatus defined in claim 1 wherein said restraining members are secured at one end to said anchor means, and at one end to a restraining member positioning means.

4. The apparatus defined in claim 1 wherein said flexible air membrane includes an air inlet means and air outlet means.

5. The apparatus defined in claim 4 wherein said air inlet means and air outlet means are spaced apart so as to create a flow of air through said air chamber.

6. The apparatus defined in claim 5 wherein said air inlet means is positioned on the order of 180 degrees away from said air outlet means.

7. The apparatus defined in claim 1 wherein said restraining members are constructed and arranged to limit the stress exerted upon said air membrane.

8. A low pressure gas storage system comprising:

an annular concrete anchor ring;

a floor of granular material enclosed within said anchor ring;

a flexible polymeric floor membrane having a periphery, said flexible polymeric floor membrane being positioned upon said floor and said periphery of said flexible polymeric floor membrane being coextensive with said anchor ring;

a flexible polymeric gas storage membrane overlying said flexible polymeric floor membrane and having a peripheral margin sealingly secured to said flexible polymeric floor membrane so as to form a gas storage chamber therebetween;

gas inlet and outlet means connecting said gas storage chamber to a source of gas;

a flexible polymeric air membrane having an exterior, a center, a peripheral margin encompassing said gas storage membrane and sealingly secured to said anchor ring to form an air chamber over said gas membrane;

air supply means;

air inlet means connecting said air chamber with said air supply means;

air outlet means for venting air from said air chamber; and a plurality of flexible restraining cables radially arranged around the exterior of said air membrane and passing over said center of said air membrane to limit the stress exerted thereon.

9. An apparatus for storing gas produced by a remote anaerobic digester, said apparatus comprising a floor, anchor means surrounding said floor, a flexible, gas retaining floor membrane positioned upon said floor and having a periphery substantially co-extensive with said anchor means, a flexible gas storage membrane overlying said flexible floor membrane and having a periphery sealingly secured to said periphery of said flexible floor membrane, said gas storage membrane and said floor membrane forming therebetween a flexible gas storage chamber, gas inlet means extending through said floor membrane for connecting said gas storage chamber to the remote anaerobic digester and for completely filling said gas storage chamber with gas from the anaerobic digester, gas outlet means communicating with said gas storage chamber, a flexible outer membrane having an exterior, and a periphery sealingly secured to said periphery of said flexible gas storage membrane, said flexible outer membrane overlying said flexible gas storage membrane to form a flexible cover over said flexible gas storage membrane, and said outer membrane and said gas storage membrane forming therebetween an air chamber, means for forcing air into said air chamber to generate a selected air pressure in said air chamber, air outlet means for venting air from said air chamber, and a plurality of flexible restraining members extending over said flexible outer membrane for restraining said flexible outer membrane, said flexible restraining members each having at least one end secured to said anchor means and being positioned against the exterior of said flexible outer membrane.

10. An apparatus for storing gas from a remote source, said apparatus comprising a floor, anchor means surrounding said floor, a flexible, gas retaining floor membrane positioned upon said floor and having a periphery substantially co-extensive with said anchor means, a flexible gas storage membrane overlying said flexible floor membrane and having a periphery sealingly secured to said periphery of said flexible floor membrane, said gas storage membrane and said floor membrane forming therebetween a flexible gas storage chamber, gas inlet means extending through said floor membrane for connecting said gas storage chamber to the remote source and for completely filling said gas storage chamber with gas from the source, gas outlet means communicating with said gas storage chamber, a flexible outer membrane having an exterior, and a periphery sealingly secured to said periphery of said flexible gas storage membrane, said flexible outer membrane overlying said flexible gas storage membrane to form a flexible cover over said flexible gas storage membrane, and said outer membrane and said gas storage membrane forming therebetween an air chamber, means for forcing air into said air chamber to generate a selected air pressure in said air chamber, and air outlet means for venting air from said air chamber, a plurality of flexible restraining members extending over said flexible outer membrane for restraining said flexible outer membrane, said flexible restraining members each having at least one end secured to said anchor means and being positioned against the exterior of said flexible outer membrane.

* * * * *